US008025360B2

(12) United States Patent
Takahashi

(10) Patent No.: US 8,025,360 B2
(45) Date of Patent: Sep. 27, 2011

(54) PACKING MECHANISM FOR FILLING A GAP BETWEEN AN EJECTION HEAD AND CAP MEMBER

(75) Inventor: Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 573 days.

(21) Appl. No.: 12/136,633

(22) Filed: Jun. 10, 2008

(65) Prior Publication Data

US 2008/0303858 A1 Dec. 11, 2008

(30) Foreign Application Priority Data

Jun. 11, 2007 (JP) ..... 2007-153934

(51) Int. Cl.
*B41J 2/165* (2006.01)

(52) U.S. Cl. ..... 347/29; 347/30

(58) Field of Classification Search ..... 347/29
See application file for complete search history.

(56) References Cited

U.S. PATENT DOCUMENTS

| | | | | |
|---|---|---|---|---|
| 4,432,004 | A * | 2/1984 | Glattli | 347/29 |
| 6,127,198 | A * | 10/2000 | Coleman et al. | 347/29 |
| 6,137,504 | A * | 10/2000 | Kawai et al. | 347/29 |
| 2003/0142166 | A1 * | 7/2003 | Ciordia | 347/36 |
| 2004/0145623 | A1 * | 7/2004 | Choi | 347/33 |
| 2010/0045732 | A1 * | 2/2010 | Fujimori et al. | 347/29 |

FOREIGN PATENT DOCUMENTS

| | | |
|---|---|---|
| JP | 2002-011864 | 1/2002 |
| JP | 2005-246640 | 9/2005 |

* cited by examiner

*Primary Examiner* — Shelby Fidler
(74) *Attorney, Agent, or Firm* — Workman Nydegger

(57) ABSTRACT

A liquid ejecting apparatus comprising a plurality of nozzles, an ejection head capable of ejecting a liquid through the nozzles, a cap member that is capable of being brought into contact with the ejection head so as to maintain or regain initial ejection characteristics of the nozzles, a packing member with a changeable volume that is capable of being packed into a gap between the cap member and the ejection head, and a driving unit that is capable of changing the volume of the packing member.

5 Claims, 8 Drawing Sheets

PACKING MECHANISM FOR FILLING A GAP BETWEEN AN EJECTION HEAD AND CAP MEMBER

BACKGROUND

The entire disclosure of Japanese Patent Application No. 2007-153934, filed Jun. 11, 2007 is expressly incorporated herein by reference.

1. TECHNICAL FIELD

The present invention relates to fluid or liquid ejecting apparatuses. More specifically, the present invention relates to liquid ejecting apparatuses which comprise a capping member which is capable of performing a capping operation on a recording head of the liquid ejecting apparatus.

2. RELATED ART

One example of a liquid ejecting apparatus currently known in the art is an ink jet recording apparatus which ejects ink through a plurality of nozzles provided in a recording head (an ejection head) toward a recording medium. To suppress degradation of ejection characteristics of the nozzles due to drying or the like, the liquid ejecting apparatuses are typically provided with a capping device having a cap member that is brought into contact with the recording head in such a manner as to enclose the nozzles.

To regain the initial ejection characteristics of the nozzles, some liquid ejecting apparatuses perform suction operations wherein the ink is sucked from the nozzles by reducing the pressure in an enclosed space established when the cap member is brought into contact with the recording head. Japanese Patent Applications JP-A-2002-11864 and JP-A-2005-246640 disclose examples of such apparatuses.

To suppress drying of ink at the nozzles and to enable a sufficient suction operation, the nozzles need to be isolated from the external space. That is, it is preferable that the nozzles are adequately enclosed by the cap member.

However, because of manufacturing errors and assembling errors of the cap member and the recording head, the cap member may not adequately cap the nozzles of the recording head, and there may be a gap between the cap member and the nozzles. In such cases, the space in which the nozzles are exposed does not maintain a sufficiently humid environment and the ink in the nozzles may dry, or the suction process may not be performed because the pressure in the space in which the nozzles are exposed may not be adequately reduced to generate the negative pressure required to suck the ink from the nozzles.

Particularly, when a line head is used as the recording head, since both the recording head and the cap member are long and narrow, the recording head and the cap member may each be easily bent. This increases the probability of a gap occurring between the cap member and the recording head.

In another exemplary case where the surface of the recording head to be brought into contact with the cap member is not flat due to irregularities, it is difficult to ensure tightness between the recording head and the cap member due to the irregularities. This increases the probability of a gap occurring between the cap member and the recording head.

BRIEF SUMMARY OF THE INVENTION

An advantage of some aspects of the invention is that it provides a liquid ejecting apparatus having a cap member and an ejection head that are capable of contacting each other with assured tightness.

A first aspect of the invention is a liquid ejecting apparatus comprising a plurality of nozzles, an ejection head capable of ejecting a liquid through the plurality of nozzles, a cap member capable of being brought into contact with the ejection head so as to maintain or regain initial ejection characteristics of the nozzles, a packing member with a changeable volume capable of filling a gap between the cap member and the ejection head, and a driving unit capable of changing the volume of the packing member.

One advantage of the present invention is that even if any gaps form between the cap member and the ejection head when the cap member and the ejection head are in contact with each other, the gap can be filled with the packing member. Therefore, the cap member and the ejection head can be assuredly brought into tight contact with each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
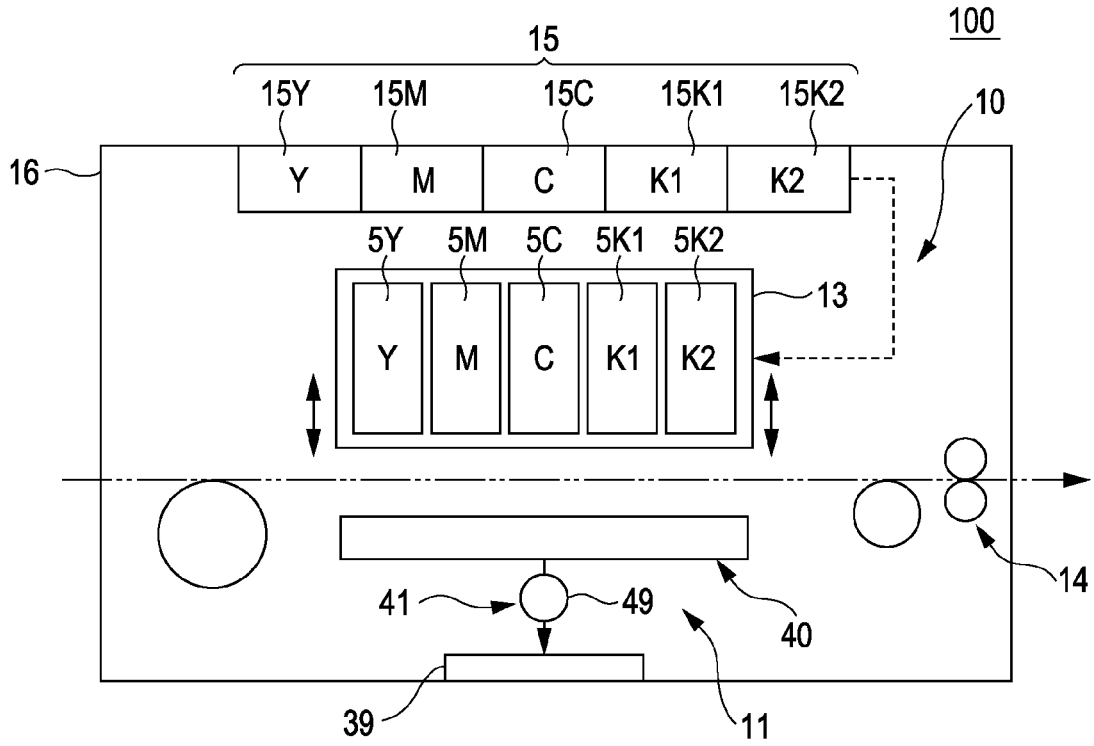
FIG. 1 is a schematic diagram of an ink jet printer according to an embodiment of the invention.

An embodiment of a liquid ejecting apparatus according to the invention will now be described with reference to the drawings. The scales of components shown in the drawings to be referred to below may be exaggerated or changed for easier recognition. In the description below, an ink jet printer is taken as an exemplary embodiment of a liquid ejecting apparatus that is capable of performing aspects of the present invention.

Figure 2:
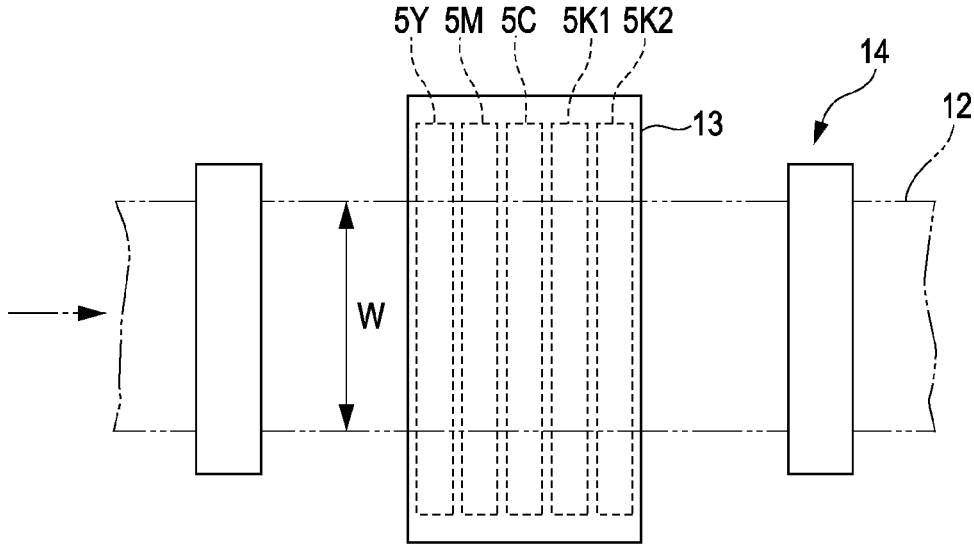
FIG. 2 is a plan view of a line head of an ink jet printer and relevant surrounding parts.
Figure 3:
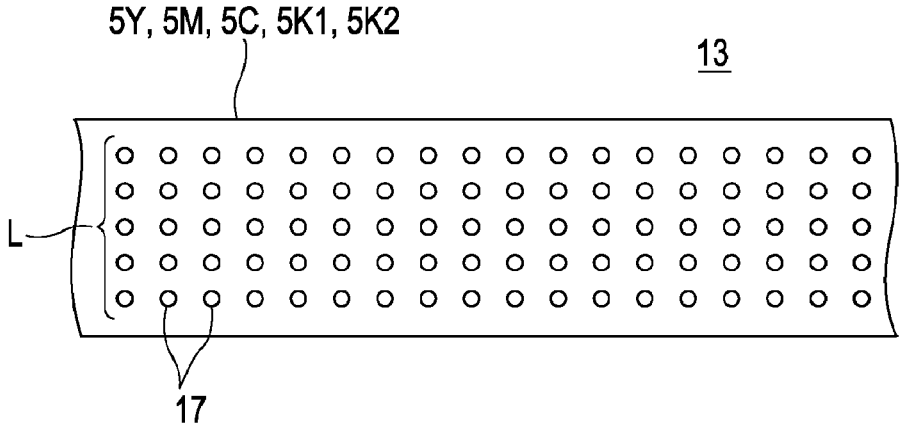
FIG. 3 is a plan view of a plurality of nozzles provided on the surface of the line head.

FIG. 1 is a schematic diagram of an ink jet printer 100 according to an embodiment of the invention. FIG. 2 is a plan view of a line head and surrounding relevant parts. FIG. 3 is a plan view of a nozzle surface of the line head.

As shown in FIGS. 1 and 2, the ink jet printer 100 includes a recording section 10 that is capable of performing recording on recording paper 12 and a maintenance section 11 that is capable of performing maintenance of the recording section 10.

The recording section 10 includes a line head 13 ejection head that is capable of forming an image on the recording paper 12, which is a target of liquid ejection, by ejecting ink droplets. The recording section 10 also includes a recording-paper transporting mechanism 14 that transports the recording paper 12, and an ink storage 15 that stores ink (liquid) which is subsequently supplied to the line head 13.

The recording-paper transporting mechanism 14 includes a paper feeding motor (not shown) which may rotate in response to a paper feeding motor, or the like. The recording-paper transporting mechanism 14 sequentially supplies the recording paper 12 during the recording or printing process, such manner that the recording paper 12 is positioned opposite the line head 13.

The ink storage 15 is disposed on one side of a printer body 16. The ink storage 15 supplies ink to the line head 13 described more fully below through a series of ink supplying means (not shown). The ink storage 15 includes ink tanks 15Y, 15M, 15C, 15K1, and 15K2 for storing different kinds of ink having a plurality of colors that may be used during the printing process, including yellow (Y) magenta (M), cyan (C), black (K1: dye-based), and black (K2: pigment-based). The ink storage 15 communicates with the line head 13 through the ink supplying means.

The line head 13 is a line-type recording head in which a number of nozzles are arranged over a length which is larger than the length of at least one side of the largest sized recording paper 12 that may be printed by the ink jet printer 100, which is referred to herein as a maximum recording-paper width W. In the embodiment, the line head 13 includes at least five print units 5Y, 5M, 5C, 5K1, and 5K2 corresponding to the respective colors (Y, M, C, K1, and K2). The print units 5Y, 5M, 5C, 5K1, and 5K2 correspond with one or more columns L of nozzles 17 (refer to FIG. 3) for ejecting ink droplets. The print units 5Y, 5M, 5C, 5K1, and 5K2 are configured so as to correlate with the direction that the recording paper 12 is transported. The number of nozzles 17 and nozzle columns L that are used in a specific line head 13 is determined according to need. FIG. 3 shows an exemplary nozzle arrangement, in which the nozzles 17 are arranged in a plurality of nozzle columns L. As the number of nozzle columns L increases, the area that can be covered in a single recording action becomes larger and the image resolution becomes higher.

The line head 13 is disposed such that the longitudinal direction of the line head 14 corresponding to the maximum recording-paper width W is orthogonal to the direction that the recording paper 12 is transported. Ink droplets are ejected through the nozzles 17 in the nozzle columns L toward the recording paper 12 in order to form an image on the recording paper 12.

The ink storage 15 and the line head 13 communicate with each other via an ink supplying means, which has a plurality of ink supplying channels 34 (refer to FIG. 5), through which ink is supplied from the ink tanks 15Y, 15M, 15C, 15K1, and 15K2 to the print units 5Y, 5M, 5C, 5K1, and 5K2, respectively.

Figure 4:
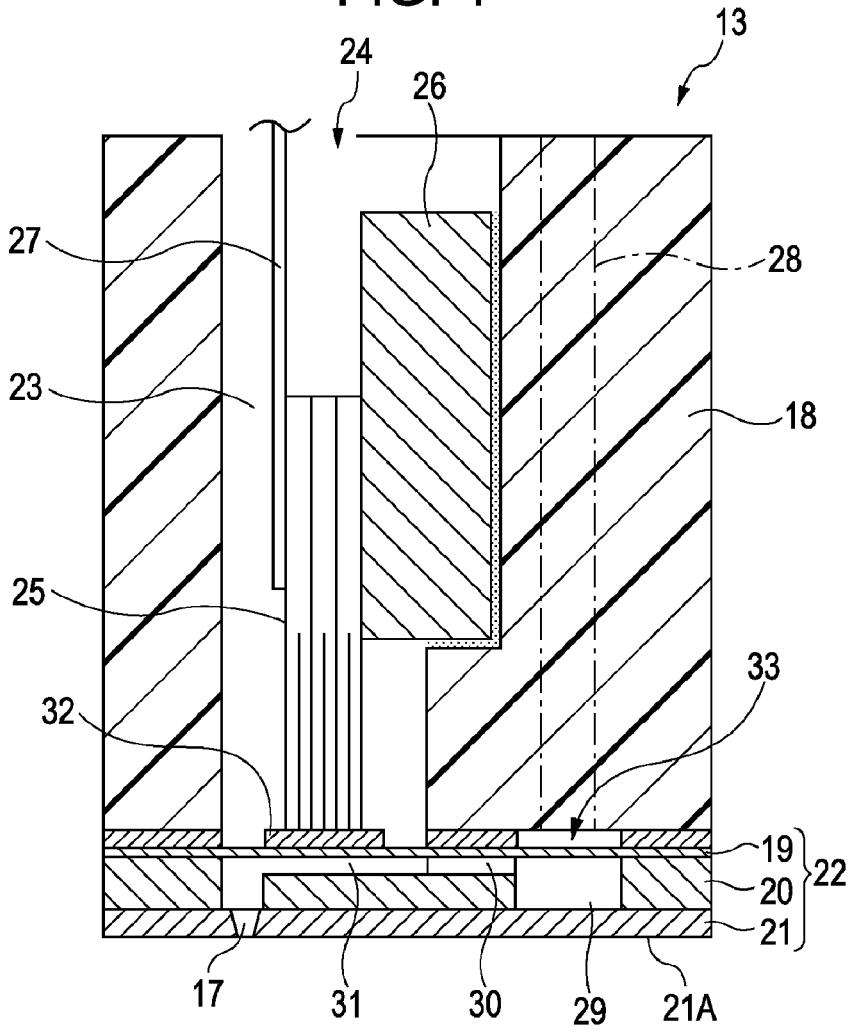
FIG. 4 is a cross-sectional view showing relevant parts of the line head.

Now, the configuration of the line head 13 will be described in detail with reference to FIG. 4, which is a cross-sectional view showing a part of the line head 13.

The line head 13 includes a head body 18 and a channel forming unit 22 comprises a vibrating plate 19, a channel plate 20, and a nozzle plate 21. The nozzles 17, through which ink is ejected, are provided in the nozzle plate 21. The bottom surface of the nozzle plate 21 is referred to as a nozzle surface 21A. The channel forming unit 22 is an integral body formed by stacking the vibrating plate 19, the channel plate 20, and the nozzle plate 21 and bonding them with an adhesive or the like.

The line head 13 includes in the head body 18 a housing space 23 and a driving unit 24 disposed in the housing space 23 for each of the print units 5Y, 5M, 5C, 5K1, and 5K2. The driving unit 24 includes a plurality of piezoelectric elements 25, a securing member 26 that secures the upper ends of the piezoelectric elements 25, and flexible cables 27 through which driving signals are supplied to the piezoelectric elements 25. The piezoelectric elements 25 correspond with the nozzles 17.

The line head 13 further includes, in the head body 18, an internal channel 28 for each of the print units 5Y, 5M, 5C, 5K1, and 5K2 through which ink from the corresponding ink tank flows. In addition, common ink chambers 29 that are capable of communicating with the internal channel 28 are formed in the channel forming unit 22 constituted by the vibrating plate 19, the channel plate 20, and the nozzle plate 21. Ink supplying ports 30 that are capable of communicating with the common ink chamber 29, and pressure chambers 31 that are capable of communicating with the ink supplying ports 30 are also formed in the channel forming unit 22. The pressure chambers 31 are provided in correspondence with the nozzles 17. The nozzles 17 communicate with the respective pressure chambers 31.

The head body 18 is made of plastic. The vibrating plate 19 is constituted by a base plate made of metal, such as stainless steel, with an elastic film laminated thereover. Portions of the vibrating plate 19 comprise islands 32 which are formed above the pressure chambers 31. The islands 32 are bonded to the lower ends of the piezoelectric elements 25. Portions of the vibrating plate 19 undergo elastic deformation in response to driving of the piezoelectric elements 25. A compliance section 33 is provided between the vibrating plate 19 and a region near the lower end of the internal channel 28.

The channel plate 20 has a series of hollowed areas that serve as the common ink chamber 29, the ink supplying ports 30, and the pressure chambers 31, each of which communicates with the nozzles via the bottom end of the internal channel 28. In the embodiment, the channel plate 20 is made of silicon and is etched in an anisotropic manner.

The nozzles 17 in the nozzle plate 21 are arranged in a predetermined direction at a predetermined pitch. The nozzle plate 21 in the embodiment is a plate member made of metal such as stainless steel.

Ink supplied from each ink tank through the corresponding ink supplying channel flows into the top end of the corresponding internal channel 28. The bottom end of the internal channel 28 communicates with the common ink chamber 29. The ink that has flowed from the ink tank through the ink supplying channel into the top end of the internal channel 28 flows through the internal channel 28 and is subsequently supplied to the common ink chamber 29. The ink that has been supplied to the common ink chamber 29 is distributed to the individual pressure chambers 31 through the respective ink supplying ports 30.

When a driving signal is input through the cable 27 to one of the piezoelectric elements 25, the piezoelectric element 25 expands or contracts. This deforms (displaces) the vibrating plate 19 in a direction towards or away from the corresponding pressure chamber 31. Accordingly, the capacity of the pressure chamber 31 changes, causing the pressure in the pressure chamber 31 storing the ink to change. This change in pressure causes the ink to be ejected through the corresponding nozzle 17.

As described above, the piezoelectric elements 25 (driving elements) in the embodiment change the pressure in the pressure chambers 31 (spaces) communicating with the nozzles 17 in accordance with the input driving signal so that the ink is ejected through the nozzles 17. Then, the ink that has been ejected through the nozzles 17 forms a desired image on the recording paper 12.

Figure 8:
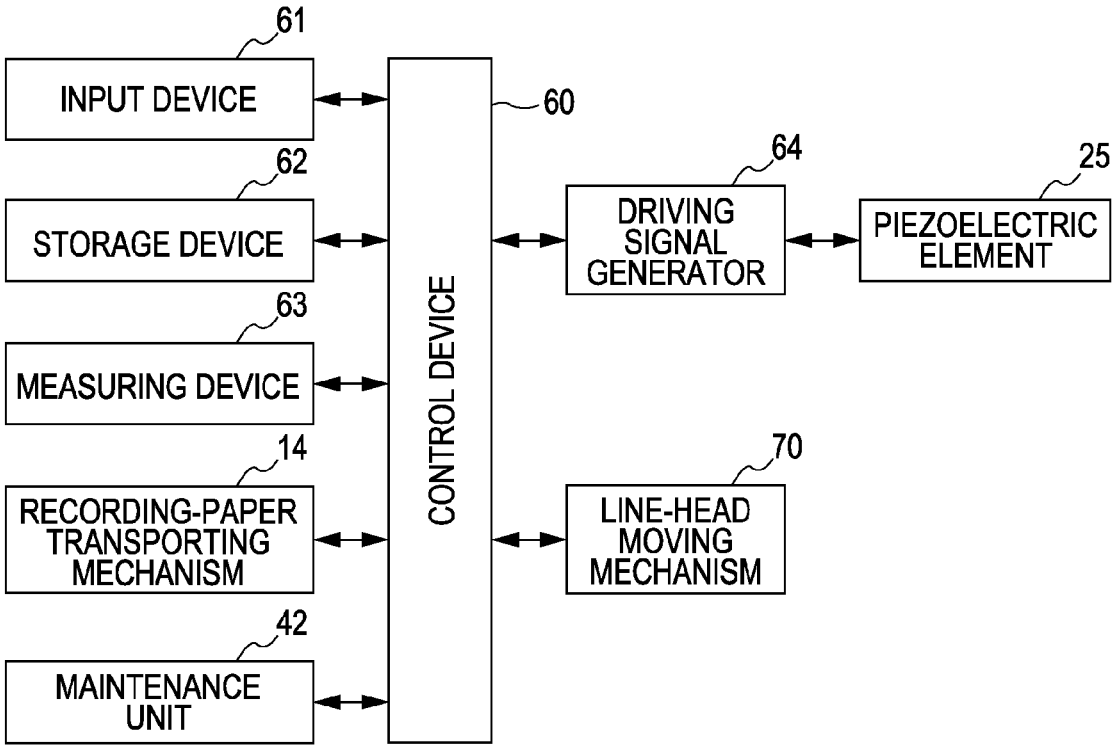
FIG. 8 is a block diagram showing the electrical configuration of the ink jet printer according to an embodiment of the invention.

The line head 13 can be moved vertically by a line-head moving mechanism 70 (refer to FIG. 8).

More specifically, the line head 13 can be moved by the line-head moving mechanism 70 in a vertical direction between a printing position and a maintenance position.

The printing position comprises a position at which recording is performed by ejecting ink from the nozzles 17 of the line head 13 toward the recording paper 12, where the line head 13 resides at a relatively upper position. The maintenance position comprises a position at which maintenance of the line head 13 is performed by the maintenance section 11, where the line head 13 resides at a relatively lower position.

Next, the configuration of the maintenance section 11 will be described in detail with reference to FIGS. 5 to 7.

Figure 7:
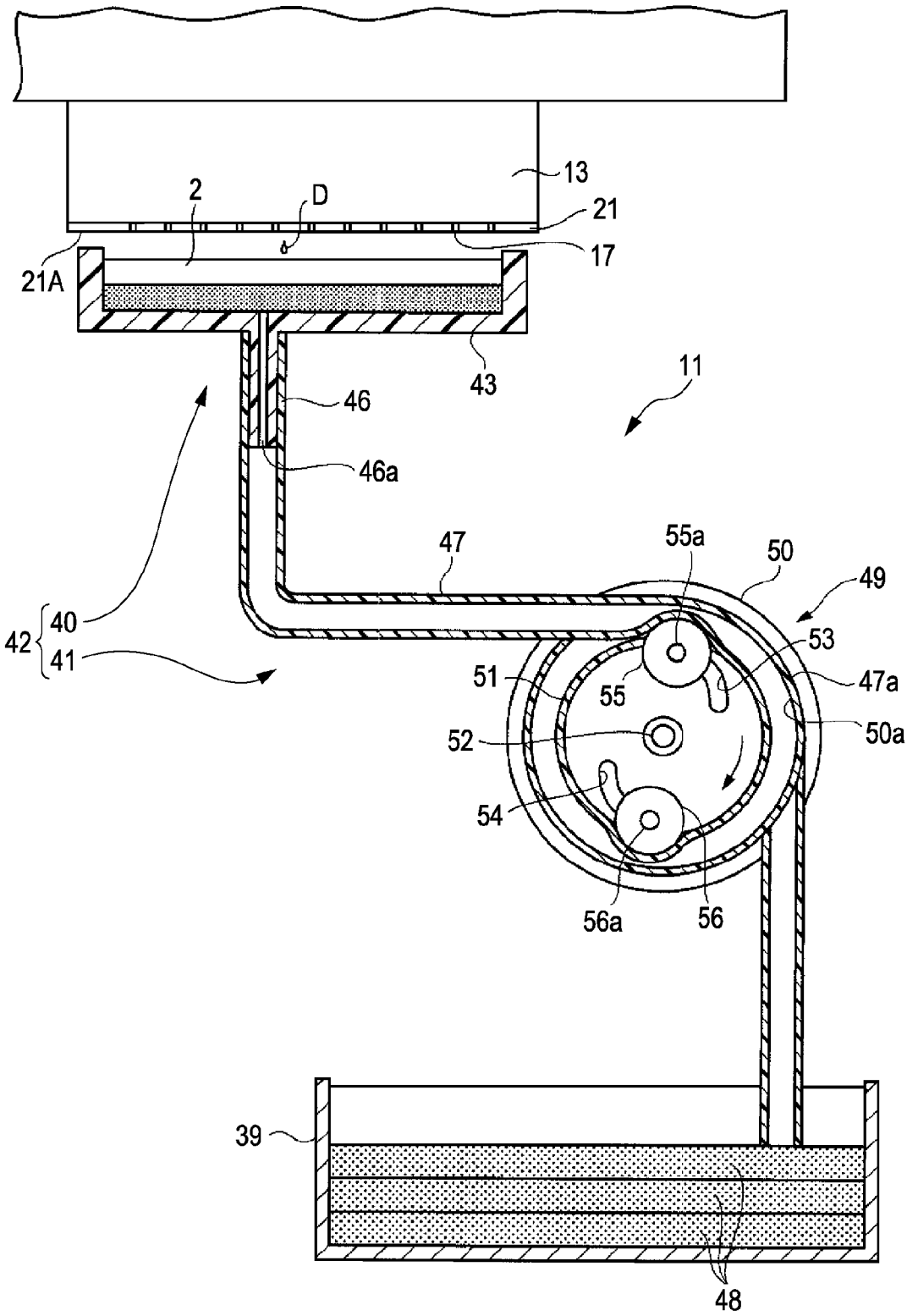
FIG. 7 is a schematic diagram of a suction pump.

As shown in FIG. 7, the maintenance section 11 includes a maintenance unit 42, a drained-ink tank 39, and the like. The maintenance unit 42 includes a capping mechanism 40 that prevents drying of ink in the nozzles 17 or an increase in viscosity of ink in the nozzles 17, and an ink draining mechanism 41 that drains ink collected at the capping mechanism 40. The drained-ink tank 39 collects the ink drained from the ink draining mechanism 41.

Figure 5:
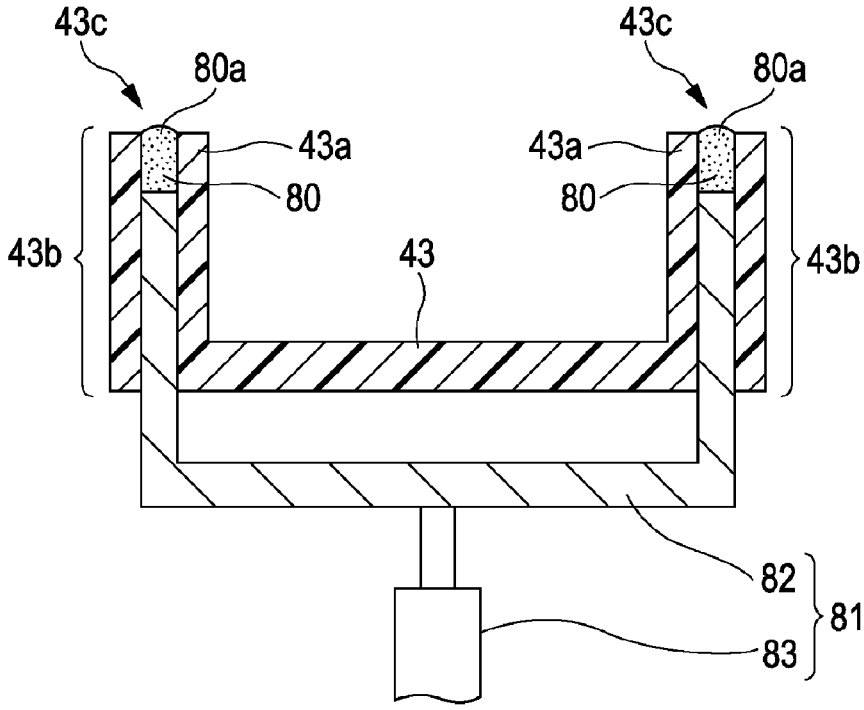
FIG. 5 is a cross-sectional view of a cap member.

As shown in FIG. 5, the capping mechanism 40 includes a cap member 43 made of resin or the like and shaped like a tray. The cap member 43 has a peripheral edge 43*a* which is shaped like a frame.

The cap member 43 can enclose a region of the line head 13 where the nozzles 17 are located when the peripheral edge 43*a* is brought into contact with the nozzle surface 21A. In this manner, a space can be established between the cap member 43 and the nozzle surface 21A.

The cap member 43 receives ink droplets D during flushing when ink droplets D are ejected in order to remove thickened ink 2, bubbles, and the like. The flushing is performed, for example, before or while the line head 13 performs recording. Therefore, a member that can absorb ink, such as a sponge member or a porous member, may also be provided inside the cap member 43.

The cap member 43 is a hollow body having an internal space 43*b*. The internal space 43*b* communicates with the outer space of the cap member 43 through an opening 43*c* provided in the top surface of the peripheral edge 43*a*.

A gel material 80 is disposed into the internal space 43*b*. The gel material 80 has a portion 80*a* which comprises a packing member that extends beyond the internal space 43*b* through the opening 43*c*. The internal space 43*b* further houses a thruster 82 that determines the volume of the gel material 80 to be thrust outside the internal space 43*b*. The thruster 82 can be moved inside the internal space 43*b* by a piston 83. The thruster 82 and the piston 83 comprise a thrust mechanism 81 (a driving unit).

Figure 6:
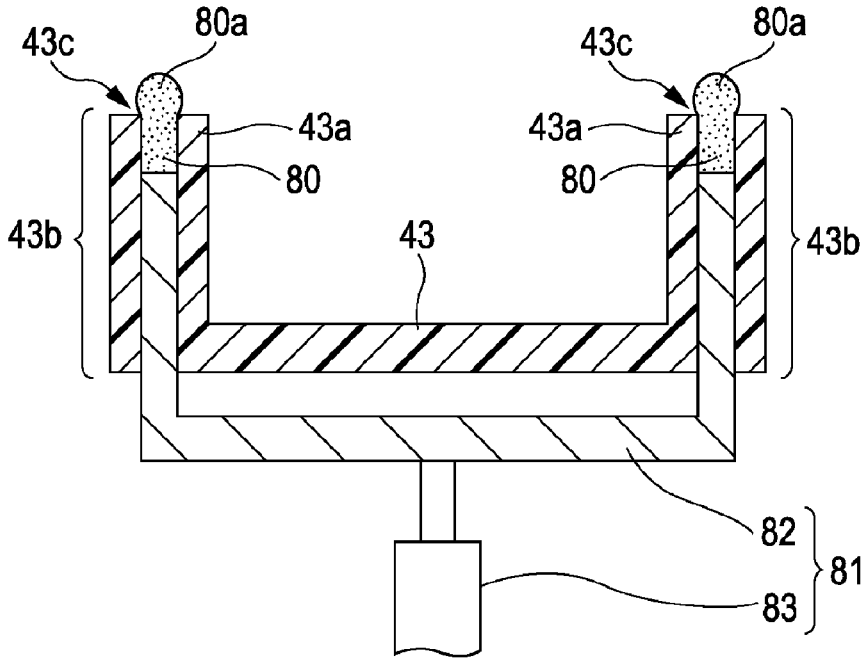
FIG. 6 is another cross-sectional view of the cap member.

Referring to FIG. 6, by driving the thrust mechanism 81, that is, by driving the piston 83, the thruster 82 thrusts the gel material 80 outside through the opening 43*c*, whereby the volume of the portion 80*a* of the gel material 80 is increased.

Further, since the gel material 80 is affixed to the thruster 82, the gel material 80 can be withdrawn into the internal space 43*b* by reversely driving the thrust mechanism 81. Accordingly, the volume of the portion 80*a* of the gel material 80 is reduced.

In this manner, the volume of the portion 80*a* of the gel material 80 outside the cap member 43 can be changed by driving the thrust mechanism 81.

The gel material 80 has elasticity that enables easy deformation thereof when a force is applied thereto, while having shape-memory characteristics that enable the gel material 80 to regain a predetermined shape when the application of the force is stopped. Further, the gel material 80 has integrity that prevents the gel material 80 from dividing into a plurality of pieces when a force is applied thereto by driving of the thrust mechanism 81. If such integrity cannot be ensured by the gel material 80 itself, the entirety or a part of the gel material 80 may be covered with an elastic protective film, for example. Thus, the integrity can be ensured.

The gel material 80 is forced when the line head 13 resides at the maintenance position, in such a manner that any gap between the line head 13 and the peripheral edge 43*a* of the cap member 43 is filled with the gel material 80. That is, the volume of the portion 80*a* of the gel material 80 changes in such a manner that any gaps between the line head 13 and the peripheral edge 43*a* of the cap member 43 is filled.

Since the gap between the line head 13 and the peripheral edge 43*a* of the cap member 43 is filled by the portion 80*a* of the gel material 80, the space defined by the cap member 43 and the nozzle surface 21A can be enclosed and isolated from the external space.

Since the space defined by the cap member 43 and the nozzle surface 21A can be enclosed, the moisture in the space is retained at a certain level with the aid of the ink held in the cap member 43, meaning that the drying of ink in the nozzles can be prevented.

Further, when the space defined by the cap member 43 and the nozzle surface 21A is enclosed, the pressure in the enclosed space can be reduced by actuating a suction pump 49, which will be described below. This enables forced draining of the ink 2 remaining in the line head 13 through the nozzles 17.

Ink Draining Mechanism

Now, the ink draining mechanism 41 will be described in detail with reference to FIG. 7, which shows the configuration of the suction pump 49 connected to the cap member 43.

The ink draining mechanism 41 includes an ink draining channel that communicates with the cap member 43 for draining ink collected in the cap member 43, the suction pump 49 for pumping the ink collected in the cap member 43 into the ink draining channel, and the like.

The bottom of the cap member 43 has a projection 46 projecting downward for draining the ink 2 collected in the cap member 43. The projection 46 has a draining path 46*a* through it. The projection 46 extends downward through a through hole (not shown) provided in the thruster 82 of the thrust mechanism 81.

The projection 46 communicates at one end with one end of a drain tube 47 (a second draining channel) made of a flexible material or the like and serving as the ink draining channel. The other end of the drain tube 47 is placed in the drained-ink tank 39.

The drained-ink tank 39 houses drained-ink absorbers 48 made of porous members. The drained-ink absorbers 48 absorb the collected ink 2.

The suction pump 49, which is of a tube pump type, is disposed between the cap member 43 and the drained-ink tank 39. The suction pump 49 has a cylindrical case 50. The case 50 houses a pump wheel 51 having a circular shape, such that the pump wheel 51 can rotate about a wheel shaft 52 provided along the central axis of the case 50. Further, the case 50 houses an intermediate portion 47*a* of the drain tube 47 in such a manner that the intermediate portion 47*a* winds along an inner wall 50*a* of the case 50.

The pump wheel 51 has a pair of roller guiding slits 53 and 54 provided on opposing sides of the wheel shaft 52. The roller guiding slits 53 and 54 each have an arched convex shape pointing toward the outer side of the pump wheel 51. Each of the roller guiding slits 53 and 54 have one end thereof positioned near the outer circumference of the pump wheel 51, with the other end thereof positioned near the inner circumference of the pump wheel 51. That is, the roller guiding slits 53 and 54 each extend from the one end to the other end so as to gradually move away from the outer circumference of the pump wheel 51.

The roller guiding slits 53 and 54 hold a pair of rollers 55 and 56, which are fitted around rotational shafts 55*a* and 56*a*, respectively. The rollers 55 and 56 serve as pressing means. The rotational shafts 55*a* and 56*a* are slidable within the respective roller guiding slits 53 and 54.

When the pump wheel 51 is rotated in a clockwise direction (as indicated by the arrow), the rollers 55 and 56 rotate via the rotational shafts 55*a* and 56*a* being guided by the respective roller guiding slits 53 and 54 towards the ends of the roller guiding slits 53 and 54 that is closest to the outer circumference of the pump wheel 51. The rollers 55 and 56 thereby squeeze or press the intermediate portion 47*a* of the drain tube 47 sequentially from the upstream portion to the downstream portion. With this movement, the pressure inside the upstream portion of the drain tube 47 with respect to the suction pump 49 is reduced.

Thus, by rotating the pump wheel 51 in a clockwise direction, the ink 2 collected in the cap member 43 is gradually drained toward the drained-ink tank 39.

When the pump wheel 51 is rotated in the reverse or counter-clockwise direction (the direction that is opposite to the arrow), the rollers 55 and 56 move toward the other end of the respective roller guiding slits 53 and 54, which are nearest to the center of the pump wheel 51. With this movement, the rollers 55 and 56 apply a decreasing pressure on the intermediate portion 47*a* of the drain tube 47, and the pressure inside the drain tube 47 is increased to its normal levels.

The pump wheel 51 is driven by the paper feeding motor of the recording-paper transporting mechanism 14.

FIG. 8 is a block diagram showing the electrical configuration of the ink jet printer 100.

Referring to FIG. 8, the ink jet printer 100 of the embodiment includes a control device 60 that is capable of controlling the overall operation of the ink jet printer 100. The control device 60 is connected with an input device 61 with which various kinds of information on the operation of the ink jet printer 100 are input, a storage device 62 that stores various kinds of information regarding the operation of the ink jet printer 100, and a measuring device 63 that is capable of measuring time. The control device 60 is also connected with the recording-paper transporting mechanism 14, the maintenance unit 42 including the cap member 43 and the suction pump 49, and the like. The ink jet printer 100 further includes a driving signal generator 64 that is capable of generating a driving signal to be input to the driving unit 24 and the piezoelectric elements 25. The driving signal generator 64 is connected to the control device 60.

The driving signal generator 64 receives a data input regarding the amount of change in the voltage of a driving pulse to send to each piezoelectric element 25 of the line head 13 and data regarding a timing signal specifying the timing for changing the voltage of the driving pulse. Based on the data and timing signal input, the driving signal generator 64 generates a driving signal containing a driving pulse DP, such as the driving pulse DP shown in FIG. 9.

Figure 9:
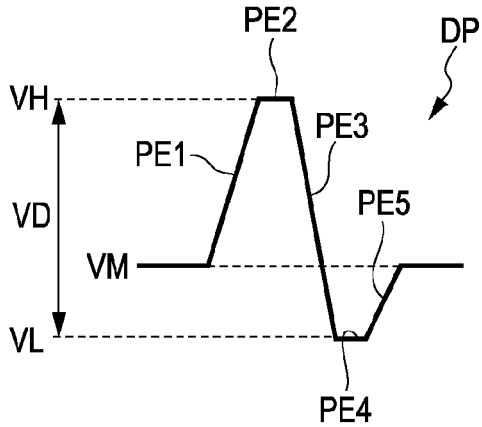
FIG. 9 shows an example of a driving signal which may be input to a piezoelectric element.

In FIG. 9, the driving pulse DP contains a first charging element PE1 that increases the potential from a reference potential VM to a highest potential VH at a predetermined gradient, a first holding element PE2 that holds the potential at the highest potential VH for a predetermined period of time, a discharging element PE3 that reduces the potential from the highest potential VH to a lowest potential VL at a predetermined gradient, a second holding element PE4 that holds the potential at the lowest potential VL for a short period of time, and a second charging element PE5 that regains the reference potential VM from the lowest potential VL. In the driving pulse DP, a driving voltage VD, which is a potential difference between the highest potential VH and the lowest potential VL, is set so that the volume of an ink droplet to be ejected through a nozzle 17 conforms to a predetermined shape and size. As may be understood by one of ordinary skill in the art, the driving pulse DP shown in FIG. 9 is only exemplary and may comprise any number of other waveforms.

In response to an input of the driving pulse DP from the driving signal generator 64 to a piezoelectric element 25, an ink droplet is ejected through the corresponding nozzle 17. When the first charging element PE1 is supplied to the piezoelectric element 25, the piezoelectric element 25 contracts and, accordingly, the corresponding pressure chamber 31 expands. After the pressure chamber 31 is kept in the expanded state for a short period of time, the discharging element PE3 is supplied to the piezoelectric element 25 and the piezoelectric element 25 rapidly expands. This causes the capacity of the pressure chamber 31 to decrease to a capacity smaller than a reference capacity (the capacity of the pressure chamber 31 when the reference potential VM is supplied to the piezoelectric element 25), causing the meniscus of ink exposed in the nozzle 17 to be rapidly pressurized outward. This causes an ink droplet of a predetermined volume to be ejected through the nozzle 17. Then, the second holding element PE4 and the second charging element PE5 are sequentially supplied to the piezoelectric element 25, causing the pressure chamber 31 to regain the reference capacity so that the vibration of the meniscus caused by ejecting the ink droplet quickly stops.

The ink jet printer 100 of the embodiment can perform maintenance of the line head 13 by using the maintenance unit 42. The maintenance unit 42 performs a maintenance operation including an operation wherein ink is removed from the nozzles 17 of the line head 13 so as to maintain or regain the initial ejection characteristics of the line head 13.

The method of performing the maintenance operation comprises flushing the ejecting ink from the nozzles 17 toward the cap member 43, and capturing the ink using the cap member 43 and the suction pump 49 of the maintenance unit 42. In one embodiment, the nozzles 17 may also retain the appropriate moisture level by using the cap member 43 used in the maintenance operation.

Flushing the line head 13 comprises pre-ejecting ink through a plurality of nozzles 17 toward the cap member 43 while the nozzle surface 21A is sealed by the cap member before the ink is provided through the nozzles 17 onto the recording paper 12. During this operation, the viscosity of ink in some of the nozzles 17 has increased because the nozzles 17 have not been used during a waiting period, and such ink is removed. Accordingly, the initial ejection characteristics of the nozzles 17 may be maintained or regained.

The suction includes an operation in which a suction force is applied to the ink in the nozzles 17 in the nozzle surface 21A using the suction pump 49 while the nozzle surface 21A is sealed by the cap member 43, generating a negative pressure in the space defined by the nozzle surface 21A and the cap member 43. Using this process, any ink with an increased viscosity that has not been removed by the flushing process is removed from the nozzles 17, along with any dust, bubbles, or other undesirable contaminants in the nozzles 17. Accordingly, the initial ejection characteristics of the nozzles 17 may be maintained or regained.

The moisture retention operation is performed when the nozzles 17 are exposed in order to keep a certain level of moisture in the nozzles 17 by enclosing the space defined by the nozzle surface 21A and the cap member 43 while the cap member 43 is collecting the ink. With this operation, drying of ink in the nozzles 17 may be suppressed and the initial ejection characteristics of the nozzles 17 may be maintained.

When a predetermined amount of ink 2 has been collected in the cap member 43, the suction pump 49 is driven to drain the ink 2 before the ink 2 overflows. Since the suction pump 49 is driven by the paper feeding motor as described above, the draining needs to be performed while the recording (printing) operation is being performed, between the initial paper feeding and final paper ejection. Therefore, it is advantageous to collect as much ink 2 as possible in the cap member 43 so as to reduce the frequency of performing the suction process.

The maintenance operation may also include wiping away any foreign substances, such as residual ink, which may adhere to the nozzle surface 21A. The foreign substances are wiped or swept off by using a wiping device (not shown).

Next, an exemplary operation of the ink jet printer 100 configured as above will be described with reference to a flowchart, focusing on the operation of the maintenance section 11 including the suction and the moisture retention embodiments of the invention.

Figure 10:
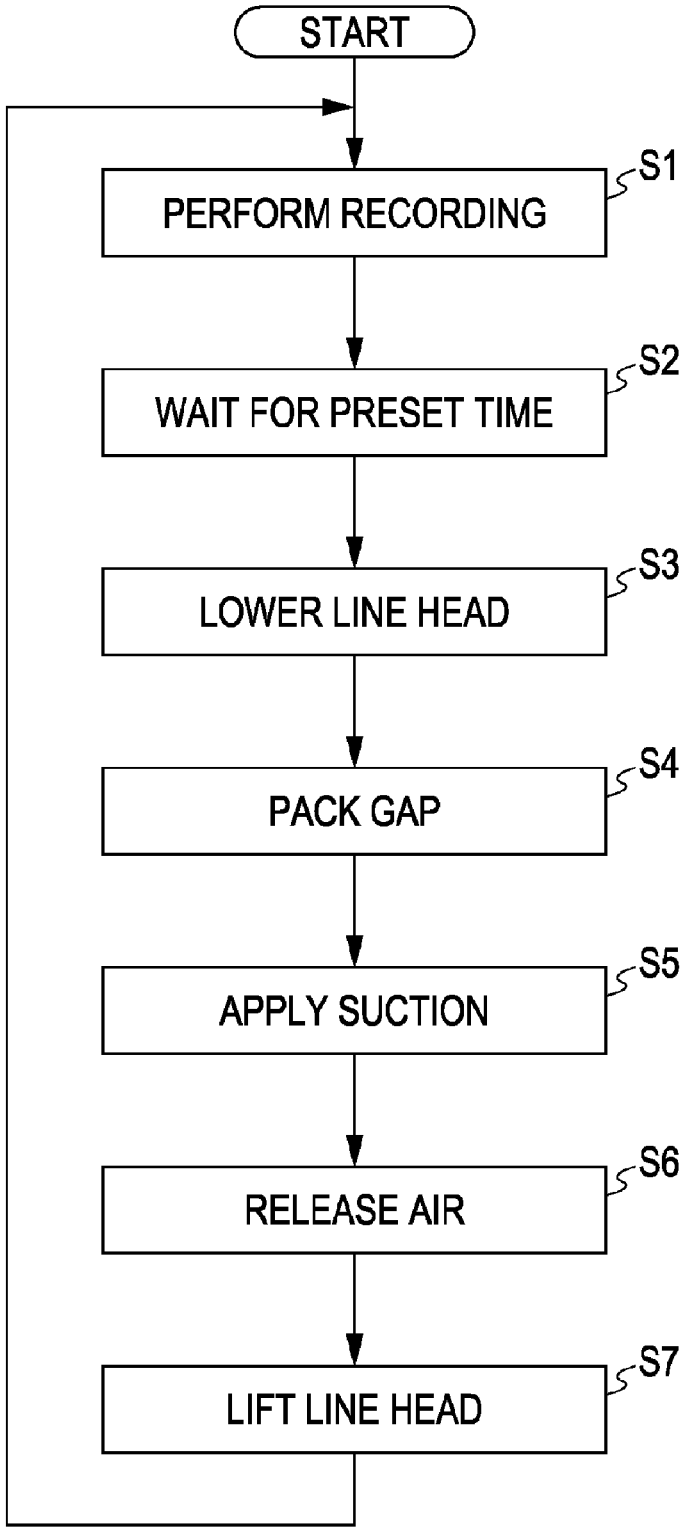
FIG. 10 is a flowchart showing an exemplary method of performing a maintenance process according to an embodiment of the invention.

The operation of the maintenance section 11 including the suction will first be described with reference to the flowchart shown in FIG. 10.

When printing data is sent from an external device to the printer 100, the control device 60 converts the data into ejection data which corresponds to a desired dot pattern which is then sent to the line head 13. In accordance with this ejection data, the line head 13 performs a recording process by ejecting the ink droplets D toward the recording paper 12 (step S1).

After a predetermined period of time (step S2), a regular maintenance process is started.

Figure 11:
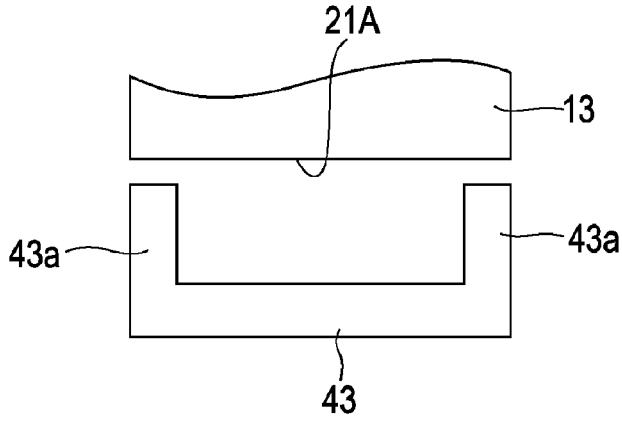
FIGS. 11-13 are explanatory diagrams illustrating a maintenance step of the method of performing the maintenance process of FIG. 10.

When the regular maintenance process is started, the control device 60 brings the nozzle surface 21A to a position facing or in contact with the cap member 43, as shown in FIG. 11, by lowering the line head 13 to the maintenance position (step S3).

During step S3, the nozzle surface 21A of the line head 13 may be positioned either a certain distance from the peripheral edge 43*a* of the cap member 43 or may be in contact with the peripheral edge 43*a* of the cap member 43. In other words, the maintenance position may be set to a position at which the nozzle surface 21A of the line head 13 resides at a certain distance from the peripheral edge 43*a* of the cap member 43 or a position at which the nozzle surface 21A of the line head 13 is in contact with the peripheral edge 43*a* of the cap member 43.

Figure 12:
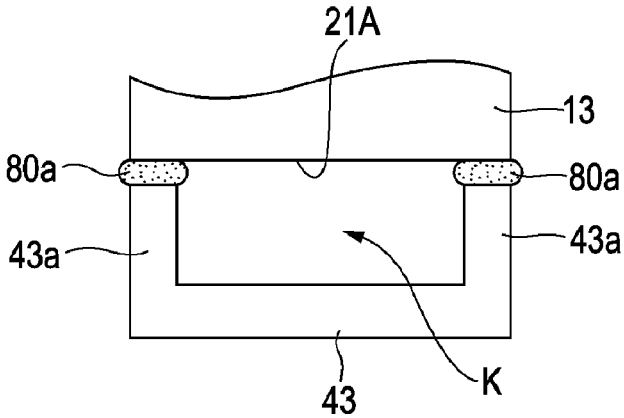

After the nozzle surface 21A is in the predetermined position in step S3, referring to FIG. 12, the control device 60 operates in such a manner that the gap between the nozzle surface 21A and the peripheral edge 43*a*, or gap between the line head 13 and the cap member 43 is packed with the portion 80*a* of the gel material 80 (step S4).

More specifically, referring to FIGS. 5 and 6, the control device 60 drives the piston 83, which is a component of the thrust mechanism 81, so as to move the thruster 82, upward toward the internal space 43*b*. This forces a portion of the gel material 80 from the internal space 43*b*. Consequently, a portion 80*a* of the gel material 80 projects outside the internal space 43*b* through the opening 43*c*. In this manner, the portion 80*a* of the gel material 80 fills the gap between the nozzle surface 21A and the peripheral edge 43*a*.

Advantageously, one benefit of the present invention is that any gaps between the nozzle surface 21A and cap member 43 that may occur when the nozzle surface 21A is brought into contact with the cap member 43 in step S3 that occur due to variations in the manufacturing and assembling processes of the line head 13 and the capping mechanism 40 may be filled.

Since the gap between the line head 13 and the peripheral edge 43*a* of the cap member 43 is filled with the portion 80*a* of the gel material 80 as described above, an enclosed space K may be reliably defined by the cap member 43 and the nozzle surface 21A and isolated from the external space.

Next, the control device 60 drives the suction pump 49 in order to reduce the pressure in the space K by applying suction, forcibly removing ink from the inside of the line head 13 through the nozzles 17 (step S5).

In this step, since the space K between by the cap member 43 and the nozzle surface 21A is enclosed as described above, the pressure in the space K can be easily reduced by driving the suction pump 49. Accordingly, the ink 2 in the line head 13 can be easily removed from the nozzles 17.

Then, the control device 60 reversely drives the suction pump 49, thereby releasing the air in the space K defined by the nozzle surface 21A and the cap member 43 to atmosphere (step S6). By reversing the drive of the suction pump 49, air flows into the space K defined by the nozzle surface 21A and the cap member 43. This releases the pressure in the space K to atmosphere. Further, by releasing the pressure in the space K defined by the nozzle surface 21A and the cap member 43 to atmosphere before parting the top edge of the cap member 43 from the nozzle surface 21A, the meniscuses of ink in the nozzles 17 remain unchanged and are not affected by the change in pressure.

Next, the control device 60 lifts the line head 13, thereby parting the cap member 43 from the nozzle surface 21A (step S7).

More specifically, referring to FIGS. 5 and 6, the control device 60 drives the piston 83 of the thrust mechanism 81, so as to move the thruster 82 downward in the internal space 43*b*. Accordingly, the gel material 80 is withdrawn from the internal space 43*b*. Consequently, the volume of the portion 80*a* of the gel material 80 that projects through the opening of 43*c* is reduced. In this manner, a gap is created between the line head 13 and the peripheral edge 43*a* of the cap member 43. After the gap is created between the line head 13 and the peripheral edge 43*a* of the cap member 43, the control device 60 causes the line head 13 to move to the printing position, thereby separating the cap member 43 from the nozzle surface 21A.

Then, the control device 60 begins recording on the recording paper 12 using the line head 13.

Figure 13:
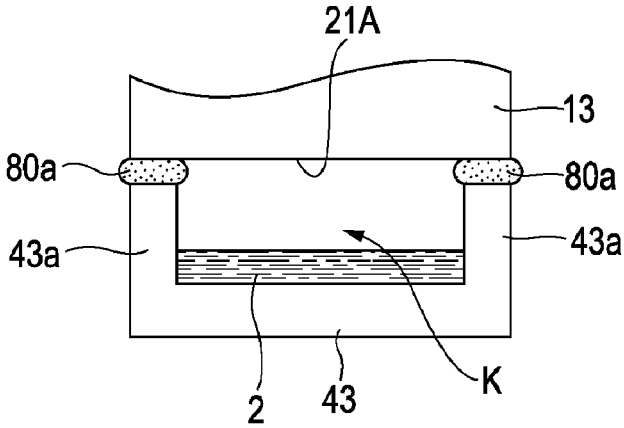

To perform the moisture retention, the control device 60 performs the above-described steps S3 and S4 while the cap member 43 has an amount of ink 2 collected therein by a flushing process or the like. Thus, referring to FIG. 13, the enclosed space K is provided with an amount of ink 2, whereby the moisture in the space in which the nozzles 17 are exposed can be kept at a certain level.

At this step, since the space K defined by the cap member 43 and the nozzle surface 21A is an enclosed space as, the moisture in the space K can be kept at an acceptable level.

Accordingly, the drying of ink in the nozzles 17 can be suppressed.

To summarize, in the ink jet printer 100 of an embodiment of the invention, the volume of the portion 80*a* of the gel material 80 is changed under the operation of the thrust mechanism 81, whereby the portion 80*a* of the gel material 80 is moved into the gap between the cap member 43 and the line head 13.

That is, even in situations where there is a gap between the cap member 43 and the line head 13 while the cap member 43 and the line head 13 are in contact with each other, the gap is filled with the portion 80*a* of the gel material 80. Therefore, the cap member 43 and the line head 13 can be brought into tight contact with each other.

In other words, in the ink jet printer 100 according an embodiment of the invention, the tightness between the cap member 43 and the line head 13 can be ensured.

Thus, although the ink jet printer 100 according to the embodiment includes the line head 13 and the cap member 43 dedicated to the line head 13 both having long and narrow shapes and therefore easy to be bent slightly, the cap member 43 and the line head 13 can be assuredly brought into tight contact with each other.

Further, even if the nozzle surface 21A is not flat, the cap member 43 and the line head 13 can be reliably brought into tight contact with each other.

The embodiment concerns an exemplary case where the gel material 80 is housed in the internal space 43*b* of the cap member 43, the cap member 43 being formed integrally with the portion 80*a* of the gel material 80. With such a configuration, the need for providing a separate space for disposing the gel material 80 is eliminated. This saves space.

Moreover, the gel material 80 and the thrust mechanism 81 may be provided in the line head 13 while the cap member 43 and the portion 80*a* of the gel material 80 are formed as an integral body.

Needless to say, the embodiment of the invention has been described using preferred examples with reference to the accompanying drawings, but the invention is not limited to such examples, and any number of combinations or variations may be made without limiting the scope thereof. It is obvious that those skilled in the art can arrive at various changes and modifications of the invention on the basis of the technical scope described in the appended claims. Such changes and modifications are naturally considered to be within the technical scope of the invention.

For example, in the previously described embodiment the packing member corresponds to a portion 80*a* of the gel material 80 that is thrust out of the cap member 43. However, the packing member is not limited thereto, and may be another element (such as a balloon) that changes the volume thereof when liquid or gas is supplied thereinto. In such a case, the driving unit according to the invention may be substituted by an air cylinder or a liquid cylinder.

In addition, the previously described embodiment concerns a configuration in which the cap member 43 has a peripheral edge 43*a* (the frame-like portion) and in which a space between the nozzle surface 21A and the cap member 43 is defined when the peripheral edge 43*a* is brought into contact with the line head 13.

However, the invention is not limited to such a configuration. The invention may also be applied to an ink jet printer that includes a so-called direct-contact cap, which is a cap member that does not have a peripheral edge 43*a*, where the entire surface of the cap member is to be brought into contact with the nozzle surface 21A.

Also, in the previously described embodiment the relative positions of the line head 13 and the cap member 43 are changed by vertically moving the line head 13, but the invention is not limited to such a configuration, and may be modified into a configuration wherein the relative positions of the line head 13 and the cap member 43 are changed by vertically moving the cap member 43.

Moreover, The line head 13 of the embodiment may include five line heads in correspondence with five different ink colors (Y, M, C, K1, and K2).

Figure 14A:
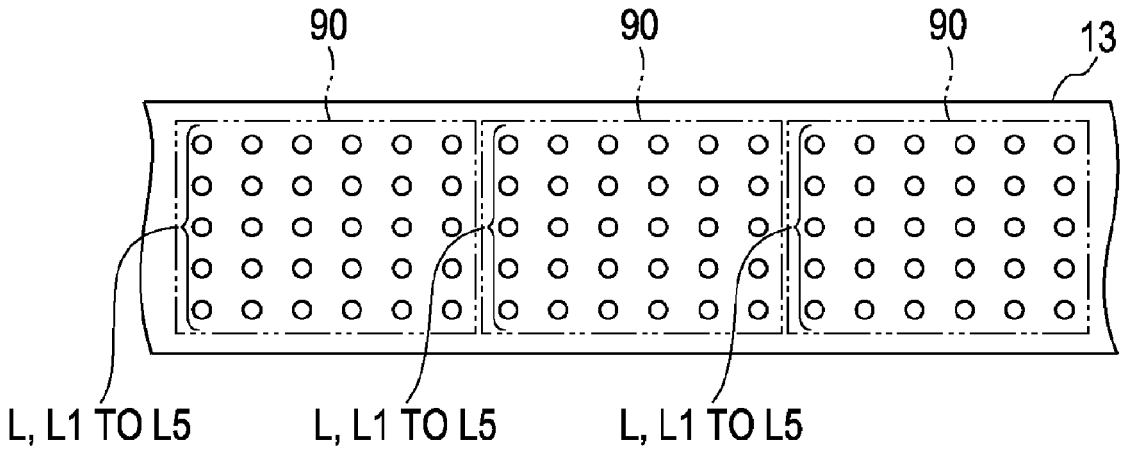
FIGS. 14A-14B illustrate line heads of other embodiments of the present invention.
Figure 14B:
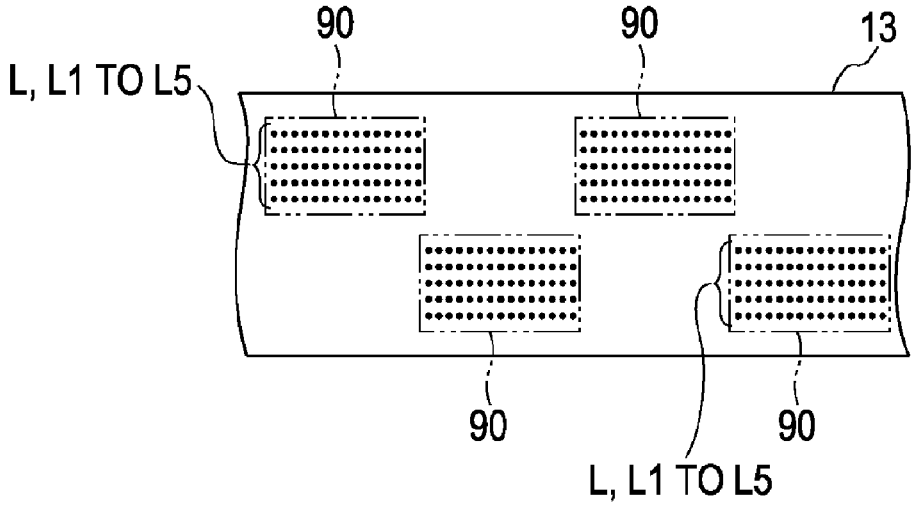

Also, referring to FIG. 14A, the line head 13 may also be a single line head divided into a plurality of units 90. Alternatively, referring to FIG. 14B, the plurality of units 90 may be arranged in a staggered manner in the longitudinal direction of the line head 13.

That is, while the previously described embodiment concerns a configuration that includes a single line head from which all kinds of ink are ejected, the invention is not limited thereto and may be of a configuration in which line heads are provided in correspondence with the respective types of ink. In such a case, the cap member 43 needs to be provided for each line head.

The invention is not limited to a line-head ink jet printer, and may be applied to a serial-head ink jet printer.

The embodiment has been described by taking an ink jet printer as an example of the ink jet recording apparatus. However, the ink jet recording apparatus is not limited thereto, and may be used in various another recording apparatuses such as copiers or facsimiles.

The embodiment has been described by taking a liquid ejecting apparatus capable of ejecting a liquid such as ink, however, the invention may also be applied to another liquid ejecting apparatuses that eject or spray liquid other than ink. The liquids that can be ejected by the liquid ejecting apparatus includes liquids, solutions in which particles of a functional material are dispersed or dissolved, gel-type liquid materials, solid materials that can be made to flow and be ejected as liquid, and powders (such as toner).

In the embodiment, the liquid that is ejected from the liquid ejecting apparatus is not limited to ink, and may be another kind of liquid intended for a particular use. With a liquid ejecting apparatus provided with an ejection head capable of ejecting the liquid for the particular use, a particular device can be manufactured by ejecting the liquid for the particular use from the ejection head in such a manner that the liquid adheres onto a particular object. Specifically, the liquid ejecting apparatus according to the invention can be applied to a liquid ejecting apparatus that ejects liquid in which a material, such as an electrode material or a colorant, used for manufacturing liquid crystal displays, electroluminescence (EL) displays, and field-emission displays (FEDs), for example, is dispersed (dissolved) in a particular dispersive medium (solvent).

The liquid ejecting apparatus may also be a liquid ejecting apparatus that ejects bioorganic material used for manufacturing biochips, or a liquid ejecting apparatus that is used as a precision pipette which ejects a liquid serving as a sample.

The invention can also be applied to any one of the following liquid ejecting apparatuses: a liquid ejecting apparatus that ejects lubricating oil toward a precision instrument such as a clock or a camera with pinpoint accuracy, a liquid ejecting apparatus that ejects transparent resinous liquid such as ultraviolet-curing resin onto a substrate for the purpose of forming microhemispherical lenses (optical lenses), for example, to be included in optical communication devices or the like, a liquid ejecting apparatus that ejects etching liquid such as acid or alkali for the purpose of etching a substrate or the like, a liquid ejecting apparatus that ejects gel, and a toner jet recording apparatus that ejects a solid such as powder including toner.

What is claimed is:

1. A liquid ejecting apparatus comprising:

a plurality of nozzles;

an ejection head capable of ejecting a liquid through the nozzles;

a cap member that is capable of being brought into contact with the ejection head so as to maintain or regain initial ejection characteristics of the nozzles;

a packing member with a changeable volume that is capable of being filled into a gap between the cap member and the ejection head; and a driving unit that is capable of changing the volume of the packing member, wherein the packing member is provided to at least one of the ejection head and the cap member, wherein the packing member is a portion of a gel material that is capable of being forced out of an internal space of the at least one of the ejection head and the cap member, and wherein the driving unit is a thrust mechanism that is capable of changing the volume of the gel material to be forced out of the internal space.

2. The liquid ejecting apparatus according to claim 1, wherein the cap member has a frame-like portion that may be brought into contact with the ejection head in such a manner as to enclose the nozzles, and wherein the packing member may be filled into a gap between the frame-like portion and the ejection head.

3. The liquid ejecting apparatus according to claim 1, wherein the ejection head is a line head.

4. A liquid ejecting apparatus comprising:

a plurality of nozzles;

a line head capable of ejecting a liquid through the nozzles;

a cap member that is capable of being brought into contact with the ejection head so as to maintain or regain initial ejection characteristics of the nozzles;

a packing member with a changeable volume that is capable of being filled into a gap between the cap member and the ejection head; and a driving unit that is capable of changing the volume of the packing member;

wherein the packing member is provided to at least one of the line head and the cap member, wherein the packing member is a portion of a gel material that is capable of being forced out of an internal space of the at least one of the ejection head and the cap member, and wherein the driving unit is a thrust mechanism that is capable of changing the volume of the gel material to be forced out of the internal space.

5. The liquid ejecting apparatus according to claim 4, wherein the cap member has a frame-like portion that may be brought into contact with the ejection head in such a manner as to enclose the nozzles, and wherein the packing member may be filled into a gap between the frame-like portion and the ejection head.

* * * * *